US009782619B2

(12) United States Patent
Wang

(10) Patent No.: US 9,782,619 B2
(45) Date of Patent: Oct. 10, 2017

(54) MUSCLES AND BONES STRETCHING HEALTH DEVICE

(71) Applicant: Yu-Jun Wang, Taichung (TW)

(72) Inventor: Yu-Jun Wang, Taichung (TW)

( * ) Notice: Subject to any disclaimer, the term of this patent is extended or adjusted under 35 U.S.C. 154(b) by 41 days.

(21) Appl. No.: 14/821,775

(22) Filed: Aug. 9, 2015

(65) Prior Publication Data

US 2017/0036052 A1 Feb. 9, 2017

(51) Int. Cl.

| | |
|---|---|
| ***A63B 21/002*** | (2006.01) |
| ***A63B 21/02*** | (2006.01) |
| ***A63B 21/055*** | (2006.01) |
| *A63B 23/02* | (2006.01) |
| *A63B 23/00* | (2006.01) |
| *A63B 21/00* | (2006.01) |

(52) U.S. Cl.

CPC ..... *A63B 21/023* (2013.01); *A63B 21/0552* (2013.01); *A63B 21/4033* (2015.10); *A63B 21/4047* (2015.10); *A63B 23/0233* (2013.01); *A63B 23/0238* (2013.01); *A63B 21/4034* (2015.10); *A63B 21/4035* (2015.10); *A63B 21/4049* (2015.10); *A63B 23/0211* (2013.01); *A63B 2023/003* (2013.01); *A63B 2023/006* (2013.01); *A63B 2208/0233* (2013.01); *A63B 2225/09* (2013.01); *A63B 2225/093* (2013.01)

(58) Field of Classification Search

CPC ..... A63B 21/0023; A63B 21/002; A63B 21/00061–21/00069; A63B 21/00047; A63B 21/02–21/028; A63B 21/04–21/0455; A63B 21/05–21/0557; A63B 23/02–23/0238; A63B 2023/003; A63B 2023/006

USPC .... 482/91, 92, 121–130, 133–140, 142, 145

See application file for complete search history.

(56) References Cited

U.S. PATENT DOCUMENTS

| | | | | | |
|---|---|---|---|---|---|
| 4,241,914 | A * | 12/1980 | Bushnell | A63B 1/00 | 482/130 |
| 4,287,620 | A * | 9/1981 | Zur | A61G 7/015 | 297/10 |
| 4,729,562 | A * | 3/1988 | Pipasik | A63B 21/0615 | 482/137 |
| 4,836,536 | A * | 6/1989 | Jones | A63B 23/0211 | 482/134 |
| 5,042,800 | A * | 8/1991 | Walter | A63B 23/03575 | 297/411.1 |
| 5,279,533 | A * | 1/1994 | Yin | A61H 7/001 | 482/123 |
| 5,460,587 | A * | 10/1995 | Hutchins | A63B 21/0628 | 482/101 |
| 5,487,590 | A * | 1/1996 | Haynes | A61G 15/007 | 297/195.11 |
| 5,624,361 | A * | 4/1997 | Lai | A63B 21/055 | 482/130 |

(Continued)

*Primary Examiner* — Andrew S Lo
*Assistant Examiner* — Garrett Atkinson
(74) *Attorney, Agent, or Firm* — Leong C. Lei

(57) ABSTRACT

A muscles and bones stretching health device is constituted by combining the following components together: a back rest, at least one elastic element, a seat cushion, at least one support boy, vertical first, second and third support elements and a base. Whereby, a variety of fitness postures can be done through the back rest, seat cushion and support bodies so as to achieve the stretch of muscles and bones, weight loss and physical fitness, and increase use convenience.

10 Claims, 9 Drawing Sheets

(56) References Cited

U.S. PATENT DOCUMENTS 6,090,022 A * 7/2000 Colecchi ..... A61H 1/0292 482/131
6,248,047 B1 * 6/2001 Abdo ..... A63B 21/023 482/121
6,716,144 B1 * 4/2004 Shifferaw ..... A63B 21/023 297/161
6,733,429 B2 * 5/2004 Nizamuddin .... A63B 21/00047 482/100
6,966,872 B2 * 11/2005 Eschenbach ..... A63B 21/068 482/142
6,976,944 B1 * 12/2005 Damasio ..... A61H 1/0222 482/112
7,179,212 B2 * 2/2007 Hsiung ..... A63B 23/02 482/140
7,322,911 B2 * 1/2008 Webber ..... A63B 23/02 482/142
7,402,128 B2 * 7/2008 Thonn, Jr. ..... A63B 21/00072 482/137
7,686,750 B2 * 3/2010 Tuller ..... A63B 21/4047 482/123
7,731,639 B1 * 6/2010 Shifferaw ..... A63B 21/00181 482/108
8,210,998 B2 * 7/2012 Chen ..... A63B 21/00181 482/130
8,465,403 B2 * 6/2013 McCall, Jr. ..... A63B 23/0205 482/142
8,556,780 B2 * 10/2013 Chen ..... A63B 21/023 482/140
2002/0013199 A1 * 1/2002 Giannelli ..... A63B 21/068 482/95
2006/0281610 A1 * 12/2006 Perez ..... A63B 23/0211 482/130
2007/0298943 A1 * 12/2007 Mehta ..... A63B 23/03575 482/115
2007/0298945 A1 * 12/2007 Mehta ..... A63B 22/14 482/130
2008/0004166 A1 * 1/2008 Oren ..... A63B 21/0004 482/142
2008/0051274 A1 * 2/2008 Greene ..... A63B 22/0002 482/142
2010/0152007 A1 * 6/2010 Le ..... A63B 26/003 482/148
2011/0039668 A1 * 2/2011 McCall, Jr. ..... A63B 23/0205 482/142
2011/0160026 A1 * 6/2011 Perez, Jr. ..... A47C 3/0252 482/142
2013/0045845 A1 * 2/2013 Verheem ..... A63B 21/0421 482/140
2014/0121070 A1 * 5/2014 Ellis ..... A63B 21/159 482/96
2014/0296042 A1 * 10/2014 Snyder ..... A63B 23/0205 482/112

* cited by examiner

MUSCLES AND BONES STRETCHING HEALTH DEVICE

(a) TECHNICAL FIELD OF THE INVENTION

The present invention relates to a muscles and bones stretching health device, on which multiple fitness postures can be done through a back rest, seat cushion and support, thereby achieving the stretch of muscles and bones, weight loss and physical fitness, and increasing use convenience.

(b) DESCRIPTION OF THE PRIOR ART

To modern people, the phenomena such as melancholy, depression, obesity and insomnia are caused easily in their daily life because of too much work and too much pressure without proper, regular exercise habits. However, proper exercises may relieve stress, and maintain good health and graceful body at the same time, and, furthermore, facilitate in body metabolism and physical strength maintenance Therefore, to solve the problem of modern people doing too little exercise and being too busy work resulting in having no time to do the outdoor exercise, currently on the market it has also introduced a variety of fitness equipment allowing customers to use. The current fitness equipment, such as treadmill, exercise bicycle, dumbbell or supine board is mostly designed only for one single exercise posture, and other exercises cannot be done until other fitness equipment is purchased, causing customers to spend too much money on fitness equipment; it is undoubtedly a heavy economic burden to customers.

SUMMARY OF THE INVENTION

To improve fitness equipment and overcome the deficiencies of the prior art mentioned above, the present invention proposes a muscles and bones stretching health device, adapted to do exercises with a variety of postures effectively, thereby achieving the stretch of muscles and bones, weight loss and physical fitness.

Therefore, the main object of the present invention is to provide a muscles and bones stretching health device, achieving the stretch of muscles and bones, weight loss and physical fitness through a back rest, seat cushion and support.

To achieve the object mentioned above, the present invention mainly includes a base, which includes a first connection portion and a base body, where at least one first connection hole is configured at a predetermined position of the first connection portion, and at least one first fixing element at a predetermined position of the base body, the first fixing element being engaged with the first connection hole to connect the first connection portion with the base body.

A first support element perpendicular to the base is configured at a predetermined position thereof, and at least one second fixing element is configured at a predetermined position of the first support element, one end of the first support element being in connection with a second connection portion. Furthermore, at least one second connection hole is configured at a predetermined position of the second connection portion, the second connection hole being engaged with the second fixing element to connect the second connection portion with the first support element. In addition, one end of the second connection portion is coupled pivotally to a back rest, and at least one elastic element is configured at the position where the back rest is coupled pivotally to the second connection portion.

A second support element perpendicular to the base is configured at a predetermined position of the base where one end thereof is in connection with the base, and another end of the second support element is in connection with at least pivotal body, one end of which is coupled pivotally to a seat cushion.

A third support element perpendicular to the base is configured at a determined position thereof, and a third fixing element and a third connection portion are configured at a predetermined position of the third support element, at least one support body being configured at a predetermined position of the third connection portion and third support element.

The middle-rear, middle and middle-front sections of the first connection portion mentioned above are respectively configured with the first connection hole, all the first connection holes being arranged to space apart from each other.

The base body mentioned above is configured with the first fixing element at middle-rear section thereof.

The first support element mentioned above is configured on the middle-front section of the base, and the second fixing element the middle-upper section of the first support element.

The second connection hole is configured at an arbitrary position of each of the middle-lower, middle and middle-upper sections of the second connection portion, all the connection holes are spaced from each other on the second connection portion.

The elastic element mentioned above is a spring.

The elastic element mentioned above includes a spring and elastic sheet.

The second support element mentioned above is configured on the middle section of the base.

The pivoting body mentioned above is configured with at least one bearing on the inside thereof.

The third support element mentioned above is configured on the middle-rear section of the base, and the third fixing element the middle-upper section of the third support element.

The third connection hole spaced apart from the other one is configured at an arbitrary position of each of the middle-lower, middle and middle-upper sections of the third connection portion mentioned above.

The support body is configured at an arbitrary position of each of the middle-lower, middle and middle-upper sections of the third connection portion and third support element mentioned above.

Furthermore, at least one cotton body is respectively put around the two sides of the support body mentioned above

DETAILED DESCRIPTION OF THE PREFERRED EMBODIMENTS

Figure 1:
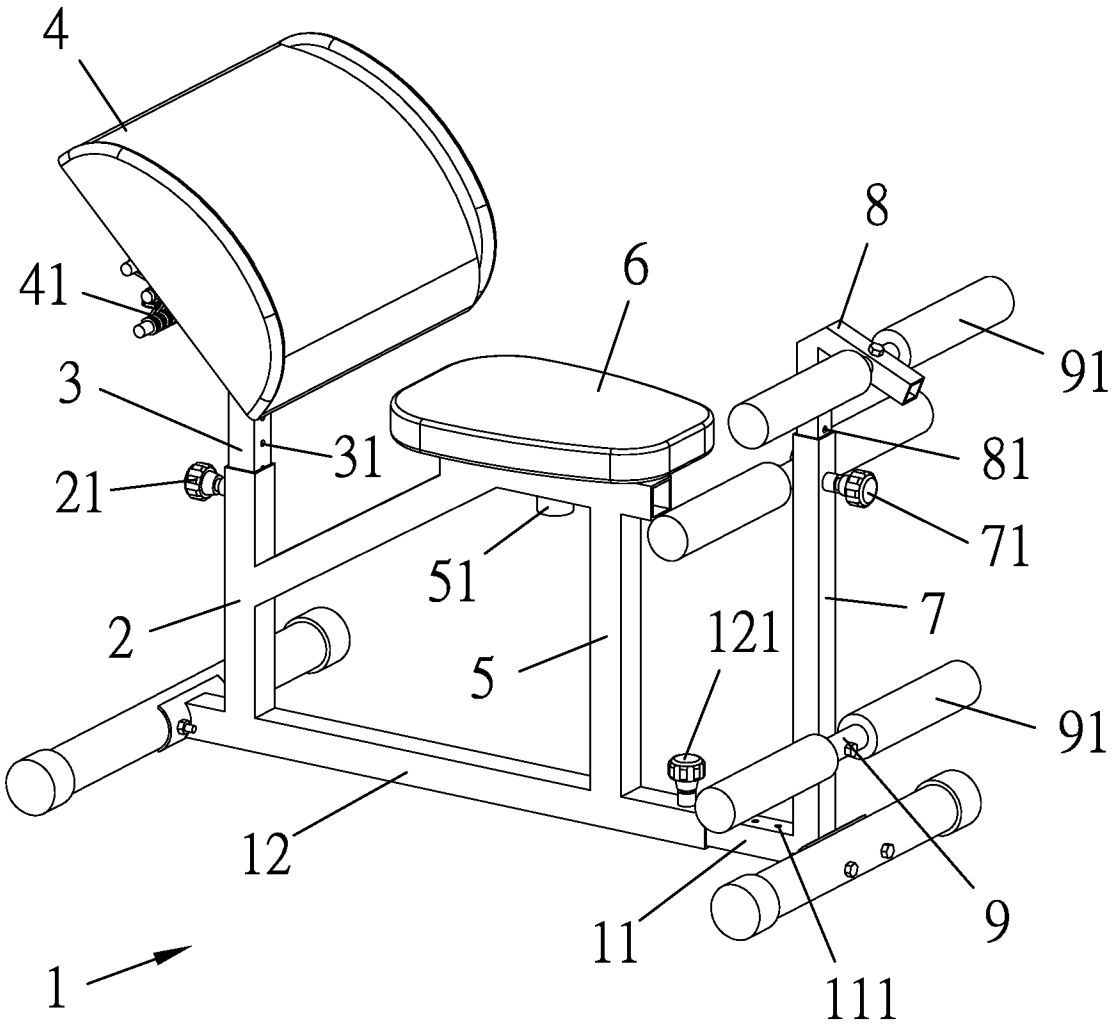
FIG. 1 is a perspective view of the present invention.
Figure 2:
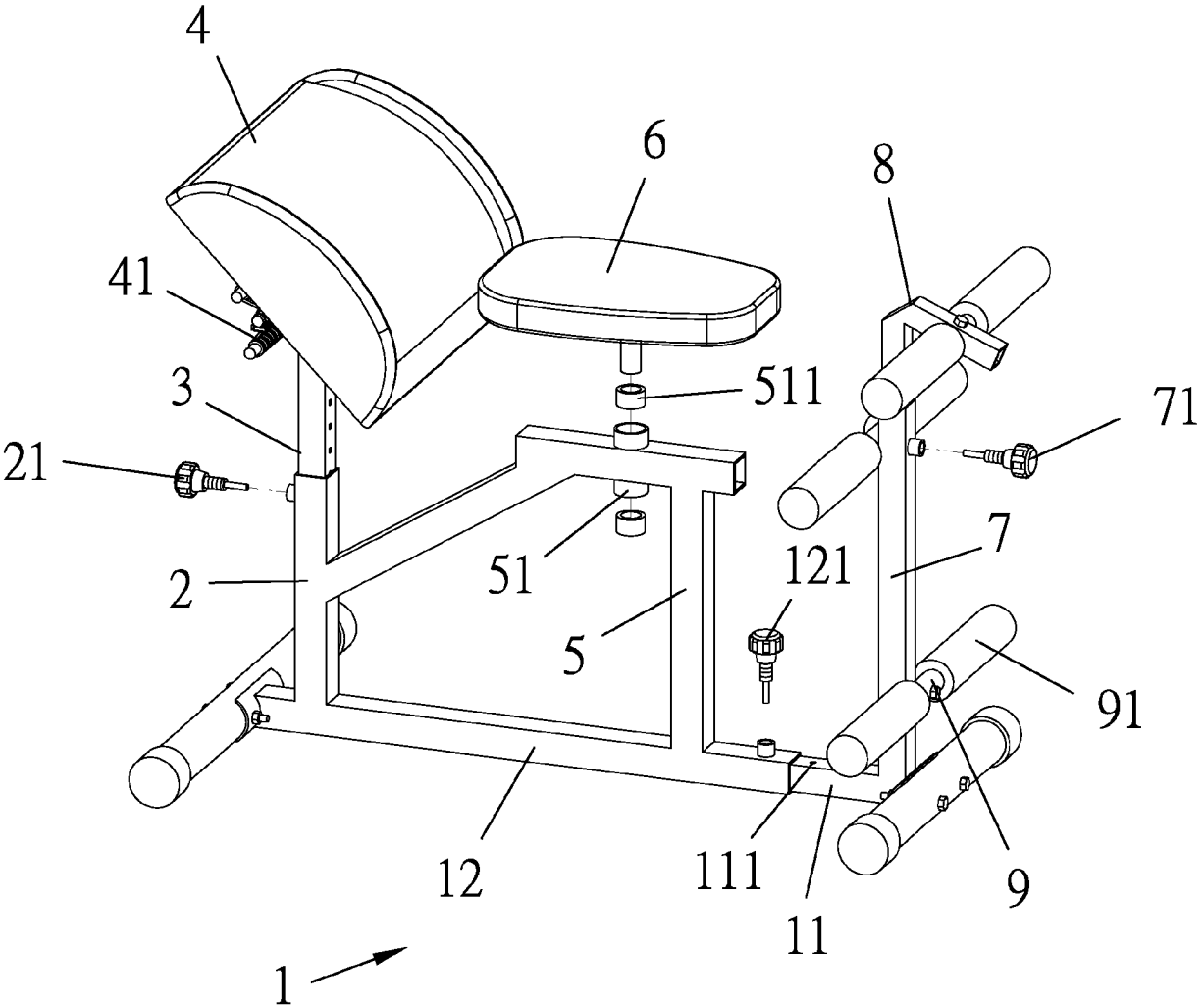
FIG. 2 is an exploded view of the present invention'
Figure 3:
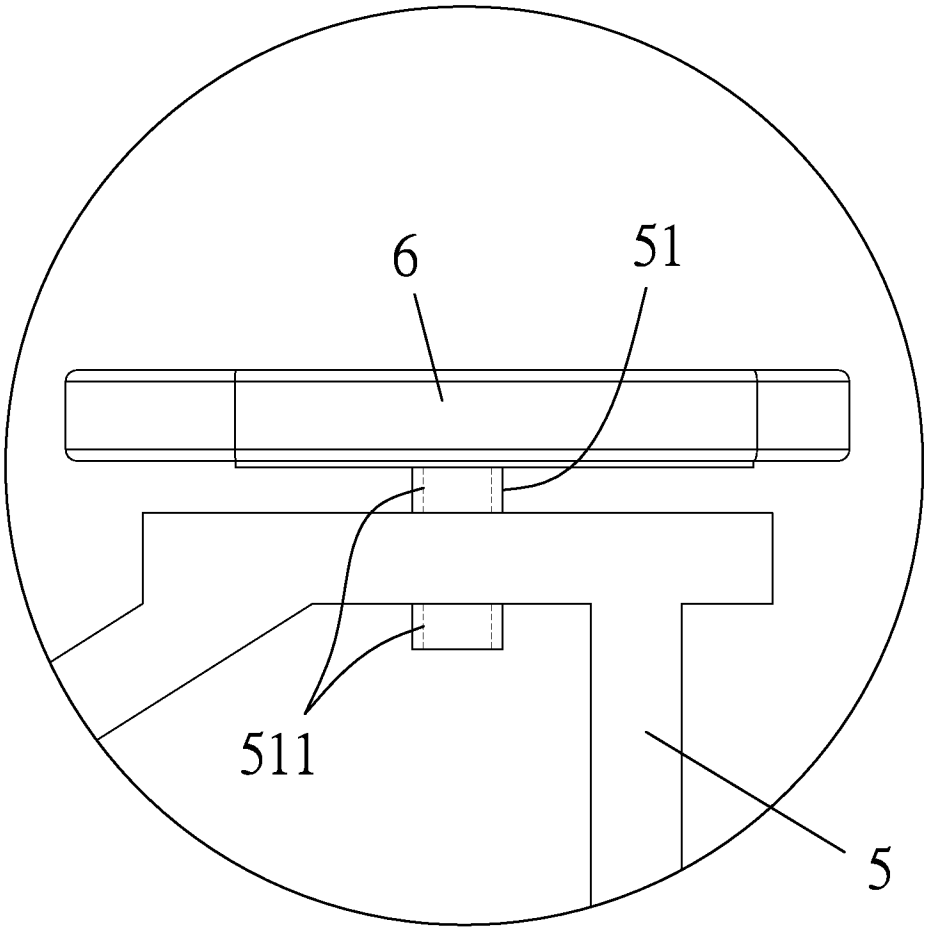
FIG. 3 is a side view of the present invention.
Figure 4:
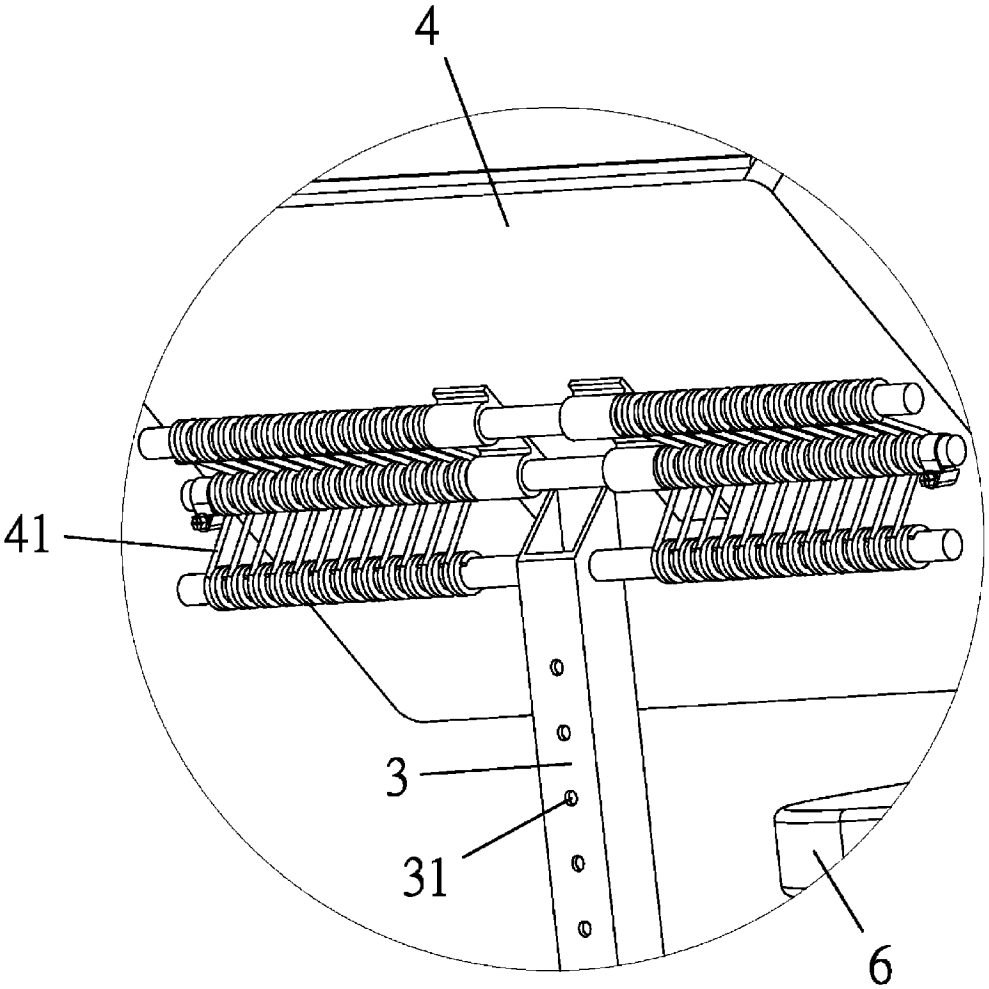
FIG. 4 is a partly enlarged view of the present invention.

Referring to FIGS. 1 to 4, which respectively are a perspective view, exploded view, side view and partly enlarged view, the present invention, as the figures show, mainly includes a base 1, which includes a first connection portion 11 and base body 12, where at least one first connection hole 111 is configured at a predetermined position of the first connection portion 11 and at least one first fixing element 121 is configured on the middle-rear section of the base body 12, the first fixing element 121 being engaged with the first connection hole 111 to connect the first connection portion 11 with the base body 12.

A first support element 2 perpendicular to the base body 12 is configured on the middle-front section of the base 1, and at least one second fixing element 21 is configured on the middle-upper section of the first support element 2. Furthermore, one end of the first support element 2 is in connection with a second connection portion 3, and at least one second connection hole 31 is configured at a predetermined position of the second connection portion 3, the second connection hole 31 being engaged with the second fixing element 21 to connect the second connection 3 with the first support element 2. In addition, one end of the second connection portion 3 is coupled pivotally to a back rest 4, and at least one elastic element 41 is configured on the position where the back rest 4 is coupled pivotally to the second connection portion 3.

A second element 4 perpendicular to the base 1 is configured on the base 1 by coupling one end of the second support element 5 to the middle section of the base 1, and the other end of the second support element 5 is in connection with at least one pivoting body 51, one end of which is coupled pivotally to a seat cushion 6.

A third support element 7 perpendicular to the base 1 is configured on the middle-rear section of the base 1, and a third fixing element 71 the middle-upper section of the third support element 7. Furthermore, one end of the third support element 7 is in connection with a third connection portion 8, and at least one third connection hole 81 is configured at a predetermined position of the third connection portion 8. In addition, at least one support body 9 is configured at a predetermined position of the third connection portion 8 and third support element 7.

The middle-rear, middle and middle-front sections of the first connection portion 11 mentioned above are respectively configured with the first connection hole 111, all the first connection holes 111 being spaced apart from each other on the first connection portion 11.

The second connection hole 31 is configured at an arbitrary position of each of the middle-lower, middle and middle-upper sections of the second connection portion 3 mentioned above, all the second connection holes being spaced apart from each other on the second connection portion 3.

The elastic element 41 mentioned above is a spring.

At least one bearing 511 is further configured inside the pivoting body 51 mentioned above.

The third support element 7 mentioned above is configured on the middle-rear section of the base 1, and the third fixing element 71 the middle-upper section of the third support element 7.

The third connection hole 81 is configured at an arbitrary position of the middle-lower, middle and middle-upper sections of the third connection portion 8 mentioned above.

As the third connection portion 8 mentioned above, the support body 9 is configured at an arbitrary position of the middle-lower, middle, middle-upper sections of the third connection portion 8 and third support element 7.

As the support body 9 mentioned above, furthermore, at least one cotton body 81 is respective put around the two sides of the support body 9.

Figure 5:
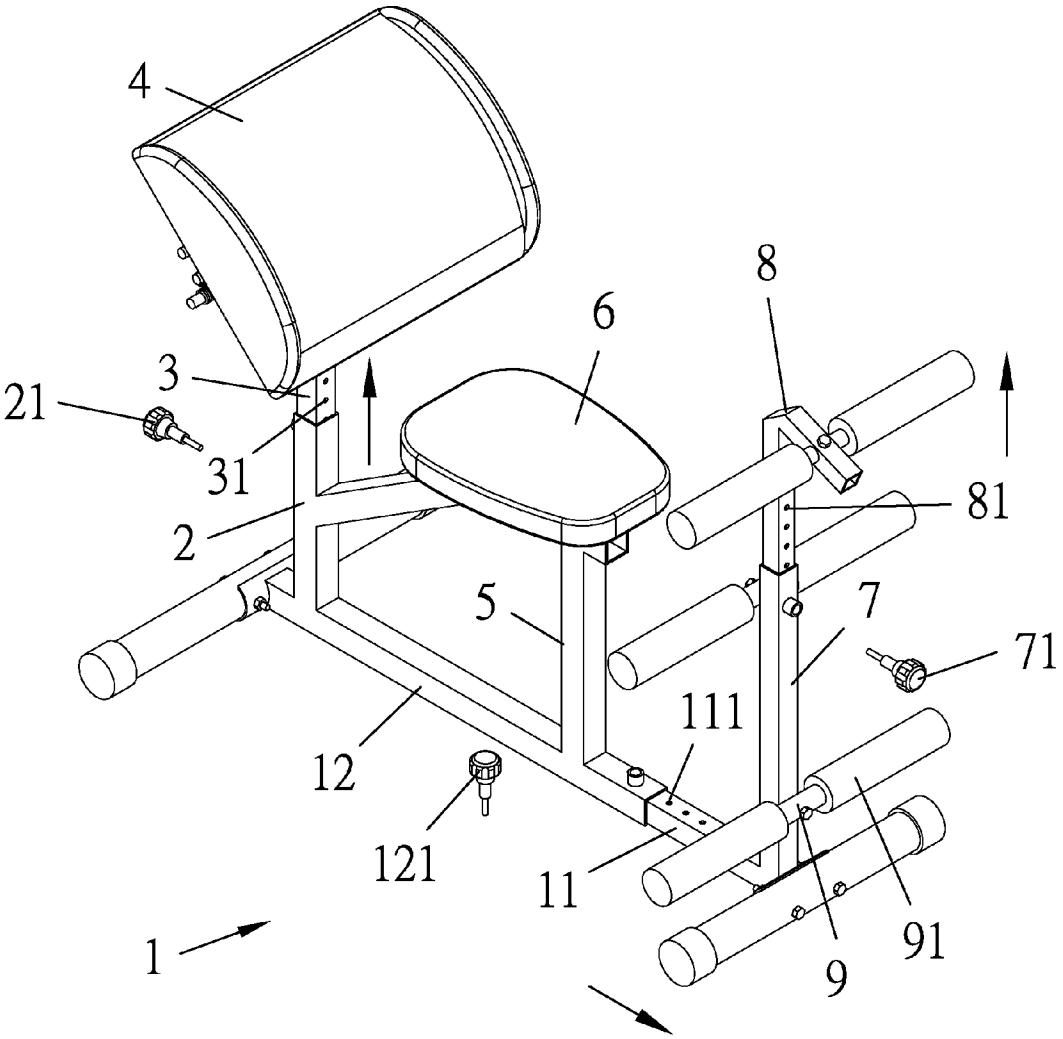
FIGS. 5 and 6 respectively are a perspective view of the present invention upon contraction or stretching.
Figure 6:
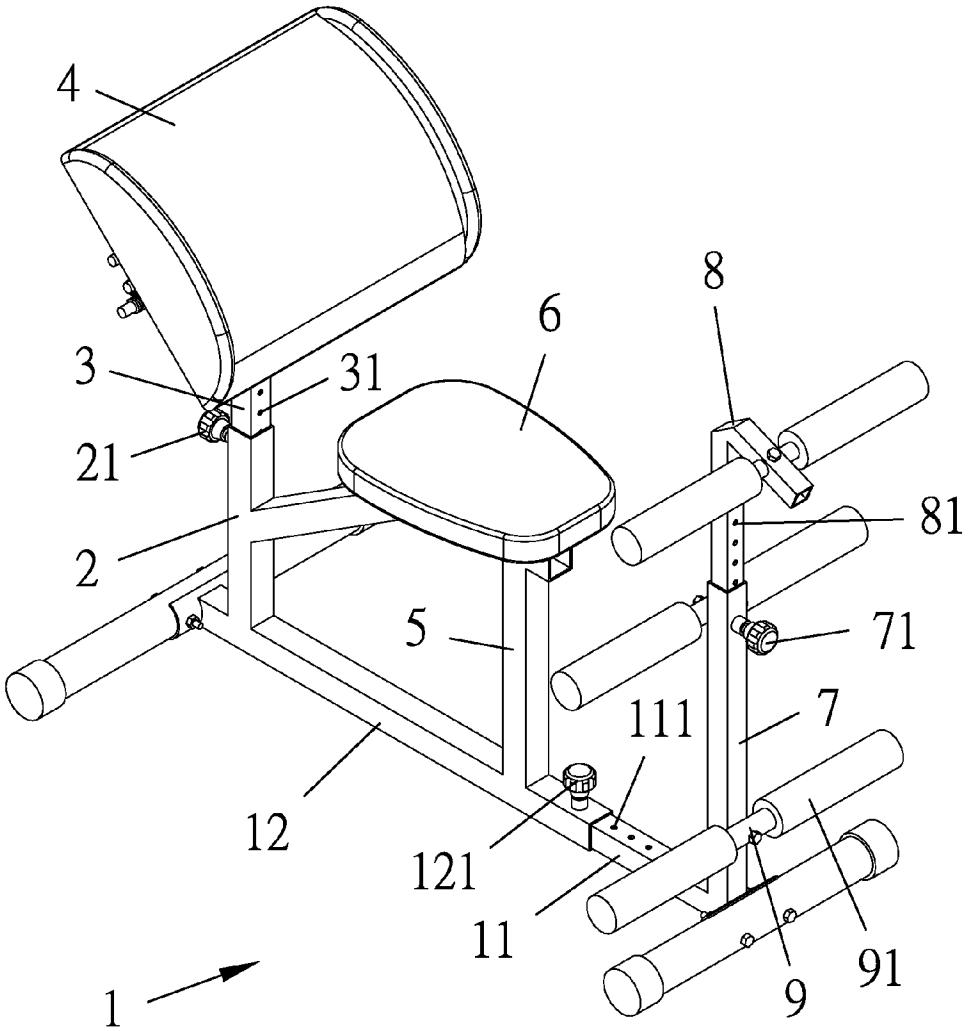

Referring to FIGS. 5 and 6, which respectively are a perspective view of the present invention upon the contraction and stretching thereof, as the figures show, the first, second and third fixing element 121, 21, 71 are respectively released from the first, second and third connection holes 111, 31, 81, and the firs connection portion 11 is then moved rightward, the second connection portion 3 upward\, and the third connection portion 8 upward. Thereafter, the first, second and third fixing elements 121, 21, 71 are respectively engaged with the other first, second and third connection holes 111, 31, 81 again, thereby contacting or stretching the present invention effectively to conform to the users' requirements.

Figure 7:
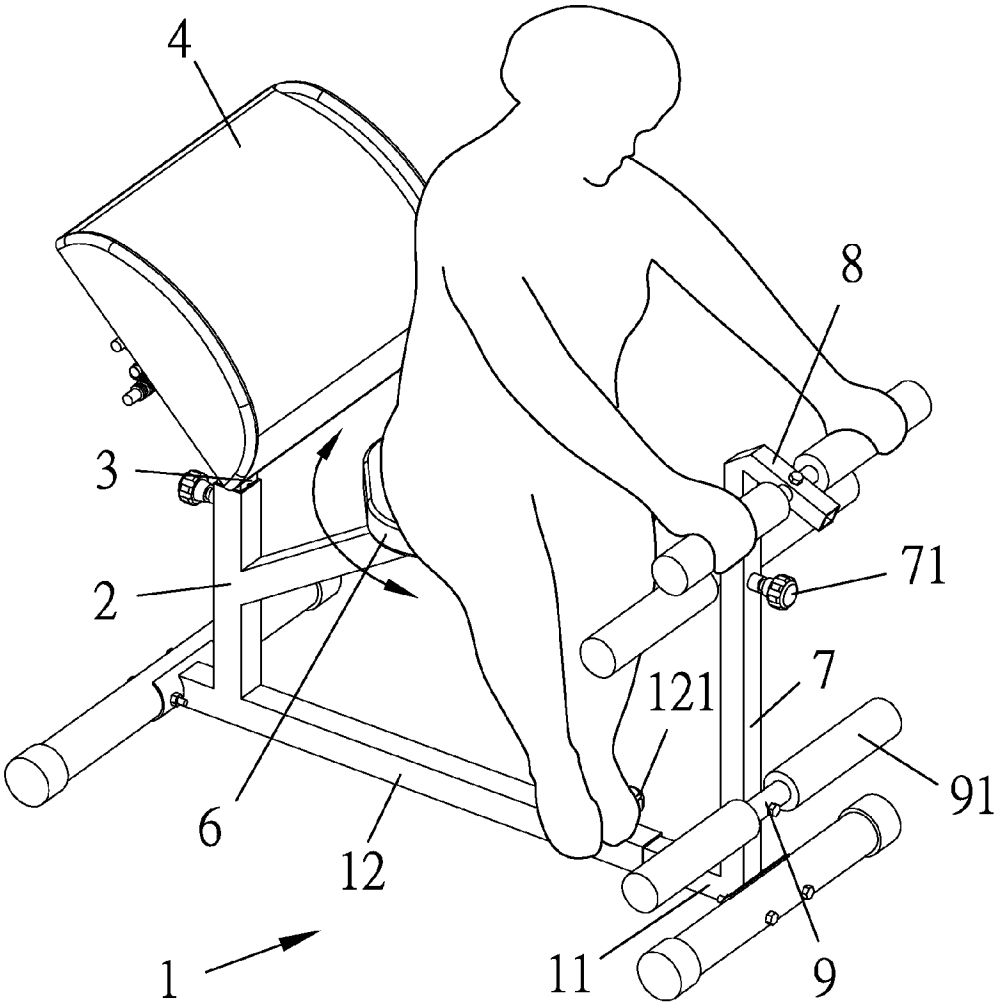
FIG. 7 is a perspective view of the present invention while the seat cushion is being put into use.

Referring to FIG. 7, , which is a perspective view of the present invention while the seat cushion is being put into use, the seat cushion 6, as the figure shows, is allowed to be rotated freely through the pivotal coupling of the seat cushion 6 to the pivoting body 51. Whereby, a user can turn around through the seat cushion 6 so as to exercise their abdomen and waist while they sit on the seat cushion 6 and put their hands on the support body 9.

Figure 8:
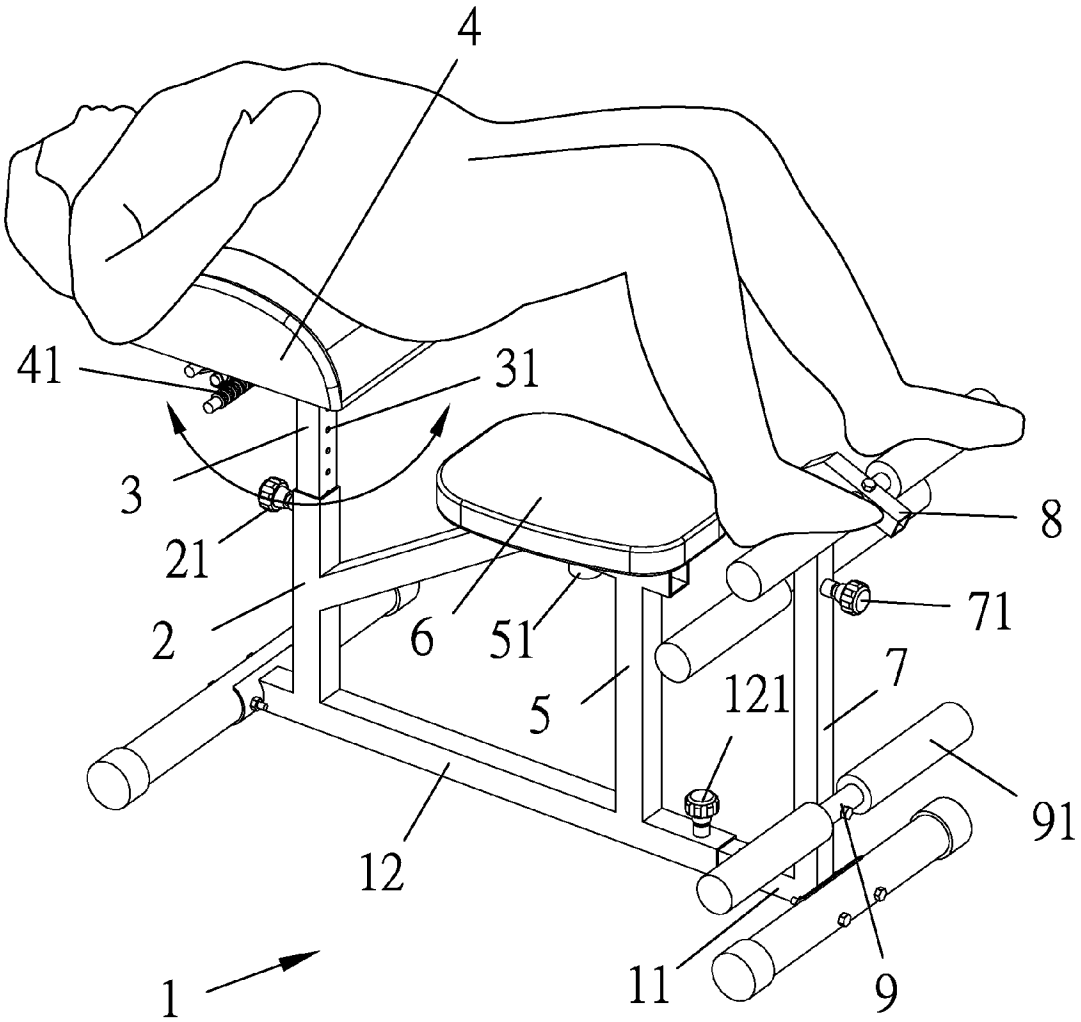
FIG. 8 is a perspective view of the present invention while a user is doing a trunk extension exercise.

Referring to FIG. 8, which is a perspective view of the present invention while a user is doing a trunk extension exercise, a user, as the figure shows, puts their back on the back rest 4 and their hips on the seat body 6, with their feet being placed on the support portion 9. Whereby, the back rest 4 is caused to be inclined rearward through the pivotal coupling of the back rest 4 to the second connection portion 3 when the user throws their back rearward, and the back rest 4 is then supported effectively through the elastic element 41 configured at the position where the back rest 4 is coupled pivotally to the first connection portion 11, with the back rest 4 being sprung back forward through the resilient force of the elastic element 41, allowing the use's body to be inclined forward to recover back to the original posture before the back throwing-back in such a way to exercise their abdomen and stretch their muscles and bones by repeating the action mentioned above.

Figure 9:
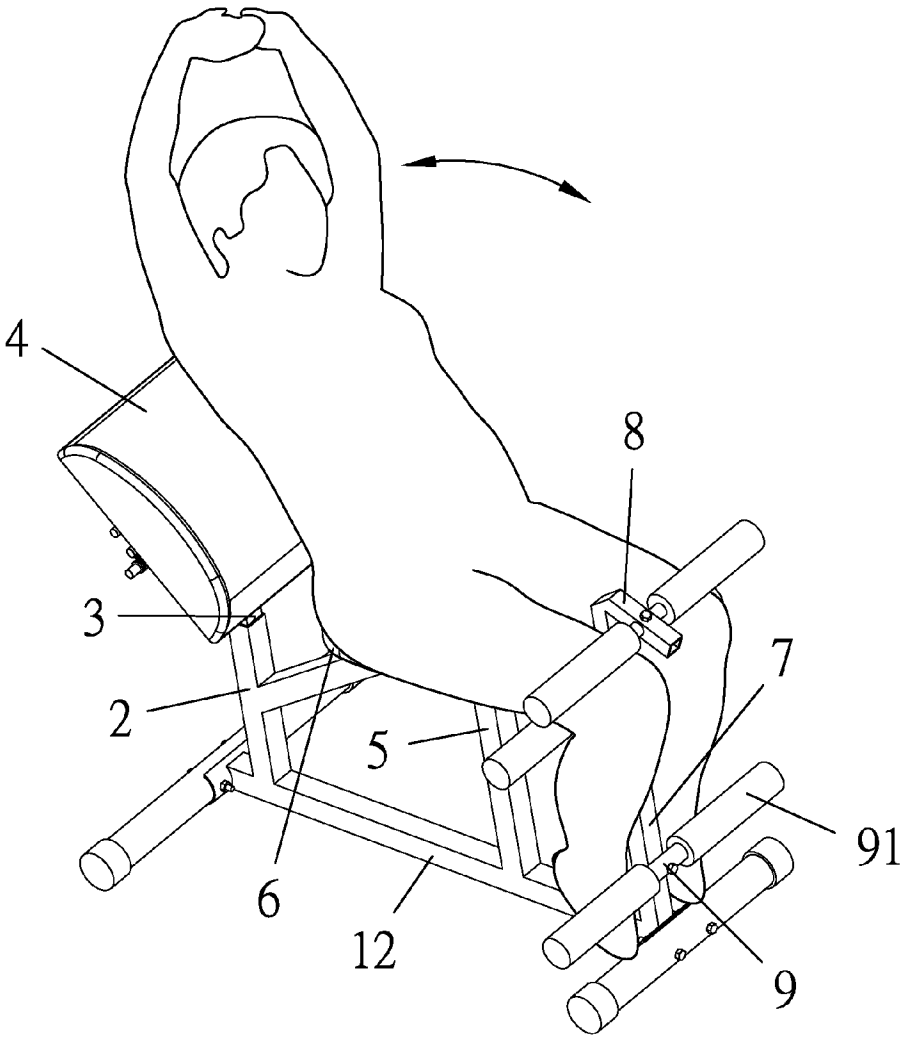
FIG. 9 is a perspective view of the present invention while a user is doing a sit-up exercise.

Referring to FIG. 9, which is a perspective view of the present invention while a user is doing a sit-up exercise, a user, as the figure shows, put their legs on the support body 9 and their hips on the seat cushion 6. Whereby, the use's body can be recovered back to the original sitting posture by supporting the legs with the support body 9 after the user inclines their body rearward to lie on the back rest 4 in such a way to exercise their abdomen by repeating the action mentioned above.

I claim:

1. A muscles and bones stretching health device, comprising:

a base;

a first support element perpendicular to said base, configured at a predetermined position of said base, one end thereof being coupled pivotally to a back rest, and at least one elastic element being configured at a place where said back rest is coupled pivotally to said first support element, wherein said at least one elastic element provides an elastic biasing force between said back rest and said first support element such that said back rest is supported at a predetermined angular position by said at least one elastic element and is allowed to rotate away from said predetermined angular position upon application of an external force thereto;

a second support element perpendicular to said base, one end thereof being in connection with said base at a predetermined position thereof, the other end thereof being coupled pivotally to a seat cushion;

a third support element perpendicular to said base, configured at a predetermined position of said base, and at least one support body being configured at a predetermined position of said third support element.

2. The device according to claim 1, wherein at least one second fixing element is configured at a middle-upper section of said first support element, one end of said first support element is in connection with a second connection portion, at least one second connection hole is configured at an arbitrary position on each of a middle-lower, middle and middle-upper sections of said second connection portion, said second connection holes being spaced apart from each other on said second connection portion, and one of said second connection holes is engaged with said second fixing element to connect said second connection portion with said first support element, with one end of said second connection portion being coupled pivotally to said back rest.

3. The device according to claim 1, wherein a pivoting body is further configured on the other end of said second support element, one end of said pivoting body being coupled pivotally to said seat cushion, and at least one bearing is further configured inside said pivoting body.

4. The device according to claim 1, wherein said first support element is configured on a middle-front section of said base, said second support element is configured on a middle section of said base, and said third support element is configured on a middle-rear section of said base.

5. The device according to claim 4, wherein said base comprises a first connection portion and a base body, at least one first connection hole is configured at an arbitrary position on each of a middle-front, middle and middle-rear sections of said connection portion, at least one first fixing element is configured on a middle-front section of said base, and said first fixing element is engaged with one of said first connection holes to connect said first connection portion with said base body.

6. The device according to claim 4, wherein said third support element is configured with a third fixing element and a third connection portion, and at least one third connection hole is configured at an arbitrary position on each of a middle-lower, middle and middle-upper sections of said third connection portion, said third connection holes being spaced apart from each other on said third connection portion.

7. The device according to claim 1, wherein said support body is configured at an arbitrary position on one of a middle-upper, middle and middle-lower section of said third support element.

8. The device according to claim 7, wherein at least one cotton body is further respectively put around two sides of said support body.

9. The device according to claim 1, wherein said elastic element is a spring.

10. The device according to claim 1, wherein said elastic element comprises a spring and elastic sheet.

* * * * *